US010119092B2

(12) United States Patent
Scherer et al.

(10) Patent No.: US 10,119,092 B2
(45) Date of Patent: Nov. 6, 2018

(54) USE OF POLYESTERS AS LUBRICANTS

(71) Applicant: BASF SE, Ludwigshafen (DE)

(72) Inventors: Markus Scherer, Mannheim (DE); Boris Breitscheidel, Waldsee (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 14/443,742

(22) PCT Filed: Nov. 8, 2013

(86) PCT No.: PCT/EP2013/073323
§ 371 (c)(1),
(2) Date: May 19, 2015

(87) PCT Pub. No.: WO2014/075993
PCT Pub. Date: May 22, 2014

(65) Prior Publication Data

US 2015/0299607 A1 Oct. 22, 2015

(30) Foreign Application Priority Data

Nov. 19, 2012 (EP) ..... 12193144

(51) Int. Cl.
*C10M 165/00* (2006.01)
*C10M 105/36* (2006.01)
*C10M 129/72* (2006.01)

(52) U.S. Cl.
CPC ..... *C10M 165/00* (2013.01); *C10M 105/36* (2013.01); *C10M 129/72* (2013.01); *C10M 2205/026* (2013.01); *C10M 2205/0285* (2013.01); *C10M 2207/282* (2013.01); *C10M 2207/2825* (2013.01); *C10N 2220/022* (2013.01); *C10N 2230/02* (2013.01); *C10N 2230/36* (2013.01)

(58) Field of Classification Search
CPC ..... C10M 165/00; C10M 2207/282; C10M 105/36; C10M 129/72; C10M 2205/026; C10M 2205/0285; C10M 2207/2825; C10N 2220/022; C10N 2230/02; C10N 2230/36
USPC ..... 508/496
See application file for complete search history.

(56) References Cited

U.S. PATENT DOCUMENTS

| | | | | |
|---|---|---|---|---|
| 3,172,892 | A | 3/1965 | Le Suer et al. | |
| 3,381,022 | A | 4/1968 | Le Suer | |
| 3,634,515 | A | 1/1972 | Piasek et al. | |
| 4,234,435 | A | 11/1980 | Meinhardt et al. | |
| 4,582,618 | A | 4/1986 | Davis | |
| 4,623,748 | A | 11/1986 | Johnson | |
| 5,849,972 | A | 12/1998 | Vicari et al. | |
| 6,437,170 | B1 * | 8/2002 | Thil | C07C 67/08 560/204 |
| 2012/0053100 | A1 * | 3/2012 | Radano | C10M 161/00 508/474 |

FOREIGN PATENT DOCUMENTS

| | | |
|---|---|---|
| DE | 4339713 | 5/1995 |
| EP | 1777285 | 4/2007 |
| WO | WO-2011/034829 | 3/2011 |

OTHER PUBLICATIONS

PCT International Search Report in PCT/EP2013/073323, dated Jan. 28, 2014, 3 pages.
PCT International Written Opinion in PCT/EP2013/073323, dated Jan. 28, 2014, 3 pages.

* cited by examiner

*Primary Examiner* — James C Goloboy
(74) *Attorney, Agent, or Firm* — Drinker Biddle & Reath LLP

(57) ABSTRACT

The presently claimed invention is directed to the novel use of polyester obtainable by reacting a mixture comprising adipic acid and an alcohol mixture comprising 1-nonanol, monomethyloctanols, dimethylheptanols and monoethylheptanols as lubricants and a lubricant composition comprising these polyesters.

15 Claims, No Drawings

USE OF POLYESTERS AS LUBRICANTS

CROSS-REFERENCE TO RELATED APPLICATIONS

This application is the National Stage entry of PCT/EP2013/073323, filed on Nov. 8, 2013, which claims priority to European Application Number 12193144.8, filed on Nov. 19, 2012, which are incorporated herein by reference in their entireties.

TECHNICAL FIELD

The presently claimed invention is directed to the novel use of polyester obtainable by reacting a mixture comprising adipic acid and an alcohol mixture comprising 1-nonanol, monomethyloctanols, dimethylheptanols and monoethylheptanols as lubricants and a lubricant composition comprising these polyesters.

BACKGROUND

The commercially available lubricant compositions are produced from a multitude of different natural or synthetic components. The lubricant compositions comprise base oils and further additives. The base oils often consist of mineral oils, highly refined mineral oils, alkylated mineral oils, poly-alpha-olefins (PAOs), polyalkylene glycols, phosphate esters, silicone oils, diesters and esters of polyhydric alcohols.

Currently Group II and Group III hydrorefined paraffinic mineral oil, GTL synthetic oil and poly-α-olefin are preferably used as base oil in lubricant compositions. However, these base oils have a detrimental effect on sealing materials which form a part of engines and mechanical transmission units. In particular, the use of these base oils leads to the shrinkage of sealing materials such as acrylonitrile butadiene rubber.

It is known that polyesters, however, accelerate the expansion of these sealing materials. Thus, specific polyesters are used in lubricant compositions in order to counteract the shrinking effect of modern base oils. In particular DIDA (diisodecyl adipate), DITA (diisotridecyl adipate) and TMTC (trimethylolpropane ester with decylic acid) are used to achieve this purpose.

In addition, the viscosity index is an important characteristic of polyesters when used as a fluid in a lubricant composition. A high viscosity index signifies that the temperature dependence of the fluid is small. Thus, a fluid which has a high viscosity index will have a low viscosity at low temperature and can be used to reduce the power consumption of an engine on start-up. In general, fluids with a high viscosity index have been shown to be more energy efficient. Thus, there is still a need in the industry to obtain fluids such as synthetic oils with a high viscosity index in order to enable energy conservation by using lubricant compositions containing those fluids.

Another advantageous characteristic of lubricant formulations is improved low temperature behaviour as expressed by low cloud points. The cloud point of a fluid such as a lubricant formulation is the temperature at which dissolved solids are no longer completely soluble, precipitating as a second phase giving the fluid a cloudy appearance.

U.S. Pat. No. 4,623,748 describes polyesters obtainable by reacting adipic acid and aliphatic alcohols such as nonanol. These polyesters can be used as lubricants.

SUMMARY

Thus, it is an object of the present invention to provide polyesters with a high viscosity index, preferably a viscosity index above 140, that lead to a high degree of expansion of sealing materials such as acrylonitrile butadiene rubber and improved low temperature characteristics—as expressed by low cloud points—when used as a component of a lubricant composition.

The object is solved by means of using a polyester obtainable by reacting a mixture comprising adipic acid and an alcohol mixture comprising 1-nonanol, monomethyloctanols, dimethylheptanols and monoethylheptanols as a lubricant, whereby the polyester has a viscosity at 40° C. in the range of 5 to 15 $mm^2/s$ determined according to DIN 51562-1. The viscosity of the polyester at 40° C. is preferably from 6 to 14 $mm^2/s$, more preferably from 7 to 13 $mm^2/s$ and most preferably from 8 to 12 $mm^2/s$ determined according to DIN 51562-1.

DETAILED DESCRIPTION

The polyesters of the invention preferably have a density at 20° C. according to DIN 51757 of from 0.85 to 1.00 $g/cm^3$, more preferably from 0.88 to 0.95 $g/cm^3$ and most preferably from 0.90 to 0.94 $g/cm^3$. The refractive index $n_D^{20}$ according to DIN 51423 is preferably from 1.400 to 1.500, more preferably from 1.420 to 1.480, and most preferably from 1.440 to 1.460.

The alcohol mixture used according to the invention is particularly advantageously obtainable in a process involving two or more stages and starting from a hydrocarbon mixture comprising butenes. In a first step, the butenes are dimerized to give a mixture of isomeric octenes. The octene mixture is then hydroformylated to give $C_9$ aldehydes and then hydrogenated to give the alcohol mixture. In this reaction sequence, specific, defined parameters have to be adhered to, at least during the butene dimerization, preferably during the butene dimerization and the hydroformylation.

It is preferable, therefore, that the isomeric octenes mixture is obtained by bringing a hydrocarbon mixture comprising butenes into contact with a heterogeneous catalyst comprising nickel oxide. The isobutene content of the hydrocarbon mixture is preferably 5% by weight or less, in particular 3% by weight or less, particularly preferably 2% by weight or less, and most preferably 1.5% by weight or less, based in each case on the total butene content. A suitable hydrocarbon stream is that known as the $C_4$ cut, a mixture of butenes and butanes, available in large quantities from FCC plants or from steam crackers. A starting material used with particular preference is that known as raffinate II, which is an isobutene-depleted $C_4$ cut.

A preferred starting material comprises from 50 to 100% by weight, preferably from 80 to 95% by weight, of butenes and from 0 to 50% by weight, preferably from 5 to 20% by weight, of butanes. The following makeup of the butenes can be given as a general guide to quantities:

| | |
|---|---|
| 1-butene | from 1 to 98% by weight, |
| cis-2-butene | from 1 to 50% by weight, |
| trans-2-butene | from 1 to 98% by weight, and |
| isobutene | up to 5% by weight. |

Possible catalysts are catalysts known per se and comprising nickel oxide, as described, for example, by O'Connor et al. in Catalysis Today, 6, (1990) p. 329. Supported nickel oxide catalysts may be used, and possible support materials are silica, alumina, aluminosilicates, aluminosilicates having a layer structure and zeolites. Particularly suitable catalysts are precipitation catalysts obtainable by mixing aqueous solutions of nickel salts and of silicates, e.g. of sodium silicate and sodium nitrate, and, where appropriate, of other constituents, such as aluminum salts, e.g. aluminum nitrate, and calcining.

Particular preference is given to catalysts which essentially consist of NiO, $SiO_2$, $TiO_2$ and/or $ZrO_2$, and also, where appropriate, $Al_2O_3$. A most preferred catalyst comprises, as significant active constituents, from 10 to 70% by weight of nickel oxide, from 5 to 30% by weight of titanium dioxide and/or zirconium dioxide and from 0 to 20% by weight of aluminum oxide, the remainder being silicon dioxide. A catalyst of this type is obtainable by precipitating the catalyst composition at pH from 5 to 9 by adding an aqueous solution comprising nickel nitrate to an aqueous alkali metal water glass solution which comprises titanium dioxide and/or zirconium dioxide, filtering, drying and annealing at from 350 to 650° C. For details of preparation of these catalysts reference may be made to DE-A 4339713. The entire content of the disclosure of that publication is incorporated herein by way of reference.

The hydrocarbon mixture comprising butenes is brought into contact with the catalyst, preferably at temperatures of from 30 to 280° C., in particular from 30 to 140° C. and particularly preferably from 40 to 130° C. This preferably takes place at a pressure of from 10 to 300 bar, in particular from 15 to 100 bar and particularly preferably from 20 to 80 bar. The pressure here is usefully set in such a way that the olefin-rich hydrocarbon mixture is liquid or in the supercritical state at the temperature selected.

Examples of reactors suitable for bringing the hydrocarbon mixture into contact with the heterogeneous catalyst are tube-bundle reactors and shaft furnaces. Shaft furnaces are preferred because the capital expenditure costs are lower. The dimerization may be carried out in a single reactor, where the oligomerization catalyst may have been arranged in one or more fixed beds. Another way is to use a reactor cascade composed of two or more, preferably two, reactors arranged in series, where the butene dimerization in the reaction mixture is driven to only partial conversion on passing through the reactor(s) preceding the last reactor of the cascade, and the desired final conversion is not achieved until the reaction mixture passes through the last reactor of the cascade. The butene dimerization preferably takes place in an adiabatic reactor or in an adiabatic reactor cascade.

After leaving the reactor or, respectively, the last reactor of a cascade, the octenes formed and, where appropriate, higher oligomers, are separated off from the unconverted butenes and butanes in the reactor discharge. The oligomers formed may be purified in a subsequent vacuum fractionation step, giving a pure octene fraction. During the butene dimerization, small amounts of dodecenes are generally also obtained. These are preferably separated off from the octenes prior to the subsequent reaction.

In a preferred embodiment, some or all of the reactor discharge, freed from the oligomers formed and essentially consisting of unconverted butenes and butanes, is returned. It is preferable to select the return ratio such that the concentration of oligomers in the reaction mixture does not exceed 35% by weight, preferably 20% by weight, based on the hydrocarbon mixture of the reaction. This measure increases the selectivity of the butene dimerization in relation to those octenes which, after hydroformylation, hydrogenation and esterification, give a particularly preferred alcohol mixture.

The octenes obtained are converted, in the second process step, by hydroformylation using synthesis gas in a manner known per se, into aldehydes having one additional carbon atom. The hydroformylation of olefins to prepare aldehydes is known per se and is described, for example, in J. Falbe, (ed.): New Synthesis with Carbon monoxide, Springer, Berlin, 1980. The hydroformylation takes place in the presence of catalysts homogeneously dissolved in the reaction medium. The catalysts generally used here are compounds or complexes of metals of transition group VIII, specifically Co, Rh, Ir, Pd, Pt or Ru compounds, or complexes of these metals, either unmodified or modified, for example, using amine-containing or phosphine-containing compounds.

For the purposes of the present invention, the hydroformylation preferably takes place in the presence of a cobalt catalyst, in particular dicobaltoctacarbonyl [$Col_2(CO)_8$]. It preferably takes place at from 120 to 240° C., in particular from 160 to 200° C., and under a synthesis gas pressure of from 150 to 400 bar, in particular from 250 to 350 bar. The hydroformylation preferably takes place in the presence of water. The ratio of hydrogen to carbon monoxide in the synthesis gas mixture used is preferably in the range from 70:30 to 50:50, in particular from 65:35 to 55:45.

The cobalt-catalyzed hydroformylation process may be carried out as a multistage process which comprises the following 4 stages: the preparation of the catalyst (precarbonylation), the catalyst extraction, the olefin hydroformylation and the removal of the catalyst from the reaction product (decobaltization). In the first stage of the process, the precarbonylation, an aqueous cobalt salt solution, e.g. cobalt formate or cobalt acetate, as starting material is reacted with carbon monoxide and hydrogen to prepare the catalyst complex needed for the hydroformylation. In the second stage of the process, the catalyst extraction, the cobalt catalyst prepared in the first stage of the process is extracted from the aqueous phase using an organic phase, preferably using the olefin to be hydroformylated. Besides the olefin, it is occasionally advantageous to use the reaction products and byproducts of the hydroformylation for catalyst extraction, as long as these are insoluble in water and liquid under the reaction conditions selected. After the phase separation, the organic phase loaded with the cobalt catalyst is fed to the third stage of the process, the hydroformylation. In the fourth stage of the process, the decobaltization, the organic phase of the reactor discharge is freed from the cobalt carbonyl complexes in the presence of process water, which may comprise formic acid or acetic acid, by treatment with oxygen or air. During this, the cobalt catalyst is destroyed by oxidation and the resultant cobalt salts are extracted back into the aqueous phase. The aqueous cobalt salt solution obtained from the decobaltization is returned to the first stage of the process, the precarbonylation. The raw hydroformylation product obtained may be fed directly to the hydrogenation. Another way is to isolate a C 9 fraction from this in a usual manner, e.g. by distillation, and feed this to the hydrogenation.

The formation of the cobalt catalyst, the extraction of the cobalt catalyst into the organic phase and the hydroformylation of the olefins can also be carried out in a single-stage process in the hydroformylation reactor.

Examples of cobalt compounds which can be used are cobalt(II) chloride, cobalt(II) nitrate, the amine complexes or hydrate complexes of these, cobalt carboxylates, such as cobalt formate, cobalt acetate, cobalt ethylhexanoate and cobalt naphthenate (Co salts of naphthenic acid), and also the cobalt caprolactamate complex. Under the conditions of the hydroformylation, the catalytically active cobalt compounds form in situ as cobalt carbonyls. It is also possible to use carbonyl complexes of cobalt such as dicobalt octacarbonyl, tetracobalt dodecacarbonyl and hexacobalt hexadecacarbonyl.

The aldehyde mixture obtained during the hydroformylation is reduced to give primary alcohols. A partial reduction generally takes place straight away under the conditions of the hydroformylation, and it is also possible to control the hydroformylation in such a way as to give essentially complete reduction. However, the hydroformylation product obtained is generally hydrogenated in a further process step using hydrogen gas or a hydrogen-containing gas mixture. The hydrogenation generally takes place in the presence of a heterogeneous hydrogenation catalyst. The hydrogenation catalyst used may comprise any desired catalyst suitable for hydrogenating aldehydes to give primary alcohols. Examples of suitable commercially available catalysts are copper chromite, cobalt, cobalt compounds, nickel, nickel compounds, which, where appropriate, comprise small amounts of chromium or of other promoters, and mixtures of copper, nickel and/or chromium. The nickel compounds are generally in a form supported on support materials, such as alumina or kieselguhr. It is also possible to use catalysts comprising noble metals, such as platinum or palladium.

A suitable method of carrying out the hydrogenation is a trickle-flow method, where the mixture to be hydrogenated and the hydrogen gas or, respectively, the hydrogen-containing gas mixture are passed, for example concurrently, over a fixed bed of the hydrogenation catalyst.

The hydrogenation preferably takes place at from 50 to 250° C., in particular from 100 to 150° C., and at a hydrogen pressure of from 50 to 350 bar, in particular from 150 to 300 bar. The desired isononanol fraction in the reaction discharge obtained during the hydrogenation can be separated off by fractional distillation from the C 8 hydrocarbons and higher-boiling products.

Gas-chromatographic analysis of the resultant alcohol mixture can give the relative amounts of the individual compounds (the percentages given being percentages by gas chromatogram area):

The proportion of 1-nonanol in the alcohol mixture of the invention is preferably from 6 to 16% by weight, more preferably from 8 to 14% by weight, related to the overall weight of the alcohol mixture.

The proportion of the monomethyloctanols is preferably from 25 to 55% by weight, more preferably from 35 to 55% by weight, and it is particularly preferable for 6-methyl-1-octanol and 4-methyl-1-octanol together to make up at least 25% by weight, very particularly preferably at least 35% by weight, related to the overall weight of the alcohol mixture.

The proportion of the dimethylheptanols and monoethylheptanols is preferably from 15 to 60% by weight, more preferably from 20 to 55% by weight, and it is preferable for 2,5-dimethyl-1-heptanol, 3-ethyl-1-heptanol and 4,5-dimethyl-1-heptanol together to make up at least 15% and in particular 20% by weight, related to the overall weight of the alcohol mixture. The proportion of the hexanols is preferably from 4 to 10% by weight and more preferably from 5 to 10% by weight, related to the overall weight of the alcohol mixture.

The alcohol mixture of the invention is preferably composed of from 70 to 100%, more preferably from 70 to 99%, most preferably from 80 to 98%, and even more preferably from 85 to 95%, of a mixture of 1-nonanol, monomethyloctanols, dimethylheptanols and monoethylheptanols, related to the overall weight of the alcohol mixture.

Preferably the alcohol mixture contains a proportion of 6% by weight to 16% by weight 1-nonanol, 25% by weight to 55% by weight monomethyloctanols, 10% by weight to 30% by weight dimethylheptanols and 7% by weight to 15% by weight monoethylheptanols, related to the overall weight of the alcohol mixture.

Preferably the alcohol mixture is present in a molar ratio in the range of 1:1 to 2:1, more preferably in a molar ratio in the range of 1:1 to 1.3:1, in relation to the adipic acid.

The density of the alcohol mixture of the invention at 20° C. is preferably from 0.75 to 0.9 g/cm$^3$, more preferably from 0.8 to 0.88 g/cm$^3$, and most preferably from 0.82 to 0.84 g/cm$^3$, according to DIN 51757. The refractive index n $D^{20}$ is preferably from 1.425 to 1.445, more preferably from 1.43 to 1.44 and most preferably from 1.432 to 1.438. The boiling range at atmospheric pressure is preferably from 190 to 220° C., more preferably from 195 to 215° C. and most preferably from 200 to 210° C.

The preparation of the polyesters of the invention is carried out in a manner known per se (cf., for example, "Ullmann's Encyclopedia of Industrial Chemistry", 5th edition, VCH Verlagsgesellschaft mbH, Weinheim, Vol. A1, pp. 214 et seq. and Vol. A9, pp. 572-575). The chain length and, respectively, average molecular weight of the polyesters can be controlled via the juncture at which the alcohol mixture is added and the amount of this mixture, and these may readily be determined as a matter of routine by the skilled worker. The catalysts used comprise conventional esterification catalysts, preferably dialkyl titanates ($(RO)_2TiO_2$, where examples of R are iso-propyl, n-butyl and isobutyl), methanesulfonic acid and sulfuric acid, more preferably the catalyst is isopropyl-n-butyl titanate.

In one preferred embodiment, the initial charge in the reaction vessel comprises adipic acid and the entire amount of the alcohol mixture. This reaction mixture is first heated to 100-140° C. and homogenized by stirring. Heating then continues to 160-190° C. at atmospheric pressure. The esterification, with elimination of water, preferably begins at about 150° C. The water of reaction formed is removed by distillation via a column. If the alcohol mixture distills over during this procedure, it is returned to the reaction vessel. The reaction vessel is then heated to 200-250° C., and further water of reaction is stripped at a pressure of from 150 to 300 mbar, by passing nitrogen through the reaction mixture. Residual water and excess alcohol mixture are stripped here, using an increased flow of nitrogen and stirring. The reaction mixture is then filtered at 100-140° C.

The polyester of the presently claimed invention can be used as a lubricant in industrial oils. Industrial oils can be selected from the group consisting of light, medium and heavy duty engine oils, industrial engine oils, marine engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, drilling detergents for the soil exploration, hydraulic oils, chain saw oil and gun, pistol and rifle lubricants.

The industrial oil may preferably comprises further additives such as polymer thickeners, viscosity index improvers, antioxidants, corrosion inhibitors, detergents, dispersants, demulsifiers, defoamers, dyes, wear protection additives, EP (extreme pressure) additives, AW (antiwear) additives and friction modifiers.

Further the industrial oil may comprise other base oils and/or co-solvents like mineral oils (Gr I, II or III oils), polyalphaolefins, alkyl naphthalenes, mineral oil soluble polyalkylene glycols, silicone oils, phosphate esters and/or other carboxylic acid esters.

Typical additives found in hydraulic oils include dispersants, detergents, corrosion inhibitors, antiwear agents, antifoamants, friction modifiers, seal swell agents, demulsifiers, VI improvers, and pour point depressants.

Examples of dispersants include polyisobutylene succinimides, polyisobutylene succinate esters and Mannich Base ashless dispersants.

Examples of detergents include metallic alkyl phenates, sulfurized metallic alkyl phenates, metallic alkyl sulfonates and metallic alkyl salicylates.

Examples of anti-wear additives include organo borates, organo phosphites, organic sulfur-containing compounds, zinc dialkyl dithiophosphates, zinc diaryl dithiophosphates and phosphosulfurized hydrocarbons.

Examples of friction modifiers include fatty acid esters and amides, organo molybdenum compounds, molybdenum dialkylthiocarbamates and molybdenum dialkyl dithiophosphates.

An example of an antifoamant is polysiloxane. Examples of rust inhibitors are polyoxyalkylene polyols, carboxylic acids or triazol components. Examples of VI improvers include olefin copolymers, polyalkylmethacrylates and dispersant olefin copolymers. An example of a pour point depressant is polyalkylmethacrylate.

The polyester of the presently claimed invention can be used as a lubricant in metalworking fluids.

Depending on the applications, e.g., straight oils (neat oils) or soluble oils, the metalworking fluid may contain applicable additives known in the art to improve the properties of the composition in amounts ranging from 0.10 to 40 wt. %. These additives include metal deactivators; corrosion inhibitors; antimicrobial; anticorrosion; emulsifying agents; couplers; extreme pressure agents; antifriction; antirust agents; polymeric substances; anti-inflammatory agents; bactericides; antiseptics; antioxidants; chelating agents; pH regulators; antiwear agents including active sulphur antiwear additive packages; a metalworking fluid additive package containing at least one of the aforementioned additives.

Depending on the end-use applications, small quantities of additives such as anti-misting agents may be optionally added in an amount ranging from 0.05 to 5.0% by vol. in one embodiment and less than 1 wt. % in other embodiments. Non-limiting examples include rhamsan gum, hydrophobic and hydrophilic monomers, styrene or hydrocarbyl-substituted styrene hydrophobic monomers and hydrophilic monomers, oil soluble organic polymers ranging in molecular weight (viscosity average molecular weight) from about 0.3 to over 4 million such as isobutylene, styrene, alkyl methacrylate, ethylene, propylene, n-butylene vinyl acetate, etc. In one embodiment, polymethylmethacrylate or poly (ethylene, propylene, butylene or isobutylene) in the molecular weight range 1 to 3 million is used.

For certain applications, a small amount of foam inhibitors in the prior art can also be added to the composition in an amount ranging from 0.02 to 15.0 wt. %. Non-limiting examples include polydimethylsiloxanes, often trimethylsilyl terminated, alkyl polymethacrylates, polymethylsiloxanes, an N-acylamino acid having a long chain acyl group and/or a salt thereof, an N-alkylamino acid having a long chain alkyl group and/or a salt thereof used concurrently with an alkylalkylene oxide and/or an acylalkylene oxide, acetylene diols and ethoxylated acetylene diols, silicones, hydrophobic materials (e.g. silica), fatty amides, fatty acids, fatty acid esters, and/or organic polymers, modified siloxanes, polyglycols, esterified or modified polyglycols, polyacrylates, fatty acids, fatty acid esters, fatty alcohols, fatty alcohol esters, oxo-alcohols, fluorosurfactants, waxes such as ethylenebisstereamide wax, polyethylene wax, polypropylene wax, ethylenebisstereamide wax, and paraffinic wax. The foam control agents can be used with suitable dispersants and emulsifiers. Additional active foam control agents are described in "Foam Control Agents", by Henry T. Kemer (Noyes Data Corporation, 1976), pages 125-162.

The metalworking fluid further comprises anti-friction agents including overbased sulfonates, sulfurized olefins, chlorinated paraffins and olefins, sulfurized ester olefins, amine terminated polyglycols, and sodium dioctyl phosphate salts. In yet other embodiment, the composition further comprises corrosion inhibitors including carboxylic/boric acid diamine salts, carboxylic acid amine salts, alkanol amines and alkanol amine borates.

The metalworking fluid further comprises oil soluble metal deactivators in an amount of 0.01 to 0.5 vol % (based on the final oil volume). Non-limiting examples include triazoles or thiadiazoles, specifically aryl triazoles such as benzotriazole and tolyltriazole, alkyl derivatives of such triazoles, and benzothiadiazoles such as $R(C_6H_3)N_2S$ where R is H or $C_1$ to $C_{10}$ alkyl.

A small amount of at least an antioxidant in the range 0.01 to 1.0 weight % can be added. Non-limiting examples include antioxidants of the aminic or phenolic type or mixtures thereof, e.g., butylated hydroxy toluene (BHT), bis-2,6-di-t-butylphenol derivatives, sulfur containing hindered phenols, and sulfur containing hindered bisphenol.

The metalworking fluid further comprises 0.1 to 20 wt. % of at least an extreme-pressure agent. Non-limiting examples of extreme pressure agents include zinc dithiophosphate, molybdenum oxysulfide dithiophosphate, molybdenum amine compounds, sulfurized oils and fats, sulfurized fatty acids, sulfurized esters, sulfurized olefins, dihydrocarbyl polysulfides, thiocarbamates, thioterpenes and dialkyl thiodipropionates.

In another embodiment, the presently claimed invention is related to a lubricant composition comprising A) at least one lubricating base oil, B) at least one polyester obtainable by reacting adipic acid and an alcohol mixture comprising 1-nonanol, monomethyloctanols, dimethylheptanols and monoethylheptanols having a viscosity at 40° C. in the range of 5 to 15 $mm^2/s$ determined according to DIN 51562-1 and C) lubricating oil additives.

For the sake of conciseness, any preferred embodiment that refers to the use of the inventively claimed polyester also refers to the lubricant composition itself.

Preferably the lubricant composition comprises 0.1% by weight to 50% by weight of component A), 50% by weight to 90% by weight of component B) and 0.1% by weight to 40% by weight of component C).

In another embodiment, the lubricant composition preferably comprises 30% by weight to 90% by weight of component A), 0.1% by weight to 50% by weight of component B) and 0.1% by weight to 40% by weight of component C).

More preferably the lubricant composition comprises 50% by weight to 90% by weight of component A), 3.5% by weight to 45% by weight of component B) and 1.0% by weight to 30% by weight of component C).

Most preferably the lubricant composition comprises 60% by weight to 90% by weight of component A), 10% by weight to 25% by weight of component B) and 2.0% by weight to 20% by weight of component C).

The viscosity of the lubricant composition at 40° C. is preferably from 60 to 140 $mm^2/s$, more preferably from 70 to 130 $mm^2/s$ and most preferably from 80 to 120 $mm^2/s$ determined according to DIN 51562-1.

Preferably the lubricating base oil is hydrorefined mineral oil and/or synthetic hydrocarbon oil. Preferably the hydrorefined mineral oil is selected from the group consisting of hydrorefined naphthenic mineral oil, API base oil classification Group II and Group III hydrorefined paraffinic mineral oil. Preferably the synthetic hydrocarbon oil is selected from the group consisting of isoparaffinic synthetic oil, GTL synthetic oil and poly-α-olefin (PAO) belonging to API base oil classification Group IV.

Preferably the lubricating oil additives are selected from the group consisting of lubricity improvers, viscosity improvers, combustion improvers, corrosion and/or oxidation inhibiting agents, pour point depressing agents, extreme pressure agents, antiwear agents, antifoam agents, detergents, dispersants, antioxidants and metal passivators.

Typical lubricity improvers are commercial acid-based lubricity improvers which have fatty acids as their main constituent and ester-based lubricity improvers which have as their main constituent glycerin mono fatty acid esters. These compounds may be used singly or in combinations of two or more kinds. The fatty acids used in these lubricity improvers are preferably those that have as their main constituent a mixture of unsaturated fatty acids of approximately 12 to 22 carbons, but preferably about 18 carbons, that is oleic acid, linolic acid and linolenic acid.

Viscosity improvers include but are not limited to polyisobutenes, polymethyacrylate acid esters, polyacrylate acid esters, diene polymers, polyalkyl styrenes, alkenyl aryl conjugated diene copolymers, polyolefins and multifunctional viscosity improvers.

Pour point depressing agents are a particularly useful type of additive, often included in the lubricating oils described herein, usually comprising substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967).

For instance, corrosion inhibiting agents, extreme pressure agents, and antiwear agents include but are not limited to dithiophosphoric esters; chlorinated aliphatic hydrocarbons; boron-containing compounds including borate esters and molybdenum compounds.

Antifoam agents used to reduce or prevent the formation of stable foam include silicones or organic polymers. Examples of these and additional antifoam compositions are described in "Foam Control Agents", by Henry T. Kerner (Noyes Data Corporation, 1976), pages 125-162. Additional antioxidants can also be included, typically of the aromatic amine or hindered phenol type. These and other additives which may be used in combination with the present invention are described in greater detail in U.S. Pat. No. 4,582,618 (column 14, line 52 through column 17, line 16, inclusive).

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant composition. Dispersants are characterized by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Another class of dispersant is high molecular weight esters. These materials are similar to Mannich dispersants or the succinimides described below, except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Other dispersants include polymeric dispersant additives, which are generally hydrocarbon-based polymers.

A preferred class of dispersants is the carboxylic dispersants. Carboxylic dispersants include succinic-based dispersants, which are the reaction product of a hydrocarbyl substituted succinic acylating agent with an organic hydroxy compound or, in certain embodiments, an amine containing at least one hydrogen attached to a nitrogen atom, or a mixture of said hydroxy compound and amine. The term "succinic acylating agent" refers to a hydrocarbon-substituted succinic acid or succinic acid-producing compound. Such materials typically include hydrocarbyl-substituted succinic acids, anhydrides, esters (including half esters) and halides. Succinimide dispersants are more fully described in U.S. Pat. Nos. 4,234,435 and 3,172,892.

The amines which are reacted with the succinic acylating agents to form the carboxylic dispersant composition can be monoamines or polyamines. Polyamines include principally alkylene polyamines such as ethylene polyamines (i.e., poly(ethyleneamine)s), such as ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene)triamine. Higher homologues such as are obtained by condensing two or more of the above-illustrated alkylene amines likewise are useful. Tetraethylene pentamines is particularly useful.

Hydroxyalkyl-substituted alkylene amines, i.e., alkylene amines having one or more hydroxyalkyl substituents on the nitrogen atoms, likewise are useful, as are higher homologues obtained by condensation of the above-illustrated alkylene amines or hydroxy alkyl-substituted alkylene amines through amino radicals or through hydroxy radicals.

The dispersants may be borated materials. Borated dispersants are well-known materials and can be prepared by treatment with a borating agent such as boric acid. Typical conditions include heating the dispersant with boric acid at 100 to 150° C.

The amount of the dispersant in a lubricant composition, if present, will typically be 0.5 to 10 percent by weight, or 1 to 8 percent by weight, or 3 to 7 percent by weight. Its concentration in a concentrate will be correspondingly increased, to, e.g., 5 to 80 weight percent.

Detergents are generally salts of organic acids, which are often overbased. Metal overbased salts of organic acids are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The overbased compositions can be prepared based on a variety of well-known organic acidic materials including sulfonic acids, carboxylic acids (including substituted salicylic acids), phenols, phosphonic acids, saligenins, salixarates, and mixtures of any two or more of these.

The basically reacting metal compounds used to make these overbased salts are usually an alkali or alkaline earth metal compound, although other basically reacting metal compounds can be used. Compounds of Ca, Ba, Mg, Na and Li, such as their hydroxides and alkoxides of lower alkanols are usually used. Overbased salts containing a mixture of ions of two or more of these metals can be used.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter.

The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, e.g., $CO_2$ or mixtures thereof, e.g., mixtures of $CO_2$ and acetic acid.

The detergents generally can also be borated by treatment with a borating agent such as boric acid. Typical conditions include heating the detergent with boric acid at 100 to 150° C., the number of equivalents of boric acid being roughly equal to the number of equivalents of metal in the salt.

The amount of the detergent component in a lubricant composition, if present, will typically be 0.5 to 10 percent by weight, such as 1 to 7 percent by weight, or 1.2 to 4 percent by weight. Its concentration in a concentrate will be correspondingly increased, to, e.g., 5 to 65 weight percent.

Examples of metal passivators include, but are not limited to, tolyltriazole and its derivatives, and benzotriazole and its derivatives. When used, the metal passivators are typically present in the fluid composition in an amount of from 0.05 to 5, more typically from 0.05 to 2, parts by weight based on the total weight of the fluid composition.

The examples below illustrate the invention in further detail without being limiting.

Examples

A) Preparation of a Polyester of the Invention

A.1) Butene Dimerization

The butene dimerization was carried out continuously in an adiabatic reactor, composed of two subreactors (length: in each case 4 m, diameter: in each case 80 cm) with intermediate cooling at 30 bar. The starting product used was a raffinate II with the following makeup:

| | |
|---|---|
| isobutane | 2% by weight |
| n-butane | 10% by weight |

-continued

| | |
|---|---|
| isobutene | 2% by weight |
| 1-butene | 32% by weight |
| trans-2-butene | 37% by weight and |
| cis-2-butene | 17% by weight. |

The catalyst used was a material prepared in accordance with DE-A 4339713, composed of 50% by weight of NiO, 12.5% by weight of $TiO_2$, 33.5% by weight of $SiO_2$ and 4% by weight of $Al_2O_3$, in the form of 5×5 mm tablets. The reaction was carried out with a throughput of 0.375 kg of raffinate II per I of catalyst and hour, with a return ratio of unreacted $C_4$ hydrocarbons returned to fresh raffinate II of 3, an inlet temperature at the 1st subreactor of 38° C. and an inlet temperature at the 2nd subreactor of 60° C. The conversion, based on the butenes present in the raffinate II, was 83.1%, and the octene selectivity was 83.3%. Fractional distillation of the reactor discharge was used to separate off the octene fraction from unreacted raffinate II and from the high-boilers.

A.2) Hydroformylation and Hydrogenation 750 g of the octene mixture prepared according to section A.1 of the examples were reacted for 5 hours discontinuously, in an autoclave, with 0.13% by weight of dicobalt octacarbonyl $Co_2(CO)_8$ as catalyst, with addition of 75 g of water, at 185° C. and with a synthesis gas pressure of 280 bar at a ratio of $H_2$ to CO in the mixture of 60/40. Further material was injected to make up for the consumption of synthesis gas, seen in a fall-off of pressure in the autoclave. After releasing the pressure in the autoclave, the reaction discharge, with 10% strength by weight acetic acid, was freed oxidatively from the cobalt catalyst by introducing air, and the organic product phase was hydrogenated using Raney nickel at 125° C. and with a hydrogen pressure of 280 bar for 10 h. The isononanol fraction was separated off from the $C_8$ paraffins and the high-boilers by fractional distillation of the reaction discharge.

The composition of the isononanol fraction was analyzed by gas chromatography. A specimen was trimethylsilylated in advance using 1 ml of N-methyl-N-trimethylsilyltrifluoracetamide per 100 μl of specimen for 60 minutes at 80° C. Use was made of a Hewlett Packard Ultra 1 separating column of length 50 m and internal diameter of 0.32 mm, with a film thickness of 0.2 μm. Injector temperature and detector temperature were 250° C., and the oven temperature was 120° C. The split was 110 ml/min. The carrier gas used was nitrogen. The admission pressure was set at 200 kPa. 1 μl of the specimen was injected and detected by FID. The compositions determined for specimens by this method (percentage by gas chromatogram area) were as follows:

| | |
|---|---|
| 11.0% | 1-nonanol |
| 20.8% | 6-methyl-1-octanol |
| 20.5% | 4-methyl-1-octanol |
| 5.3% | 2-methy-1-octanol |
| 11.0% | 2,5-dimethyl-1-heptanol |
| 8.7% | 3-ethyl-1-heptanol |
| 6.2% | 4,5-dimethyl-1-heptanol |
| 2.9% | 2-ethyl-1-heptanol |
| 2.8% | 2,3-dimethyl-1-heptanol |
| 3.0% | 2-ethyl-4-methyl-1-hexanol |
| 2.7% | 2-propyl-1-hexanol |
| 1.6% | 3-ethyl-4-methyl-1-hexanol |

The density of this isononanol mixture was measured at 20° C. as 0.8326, and the refractive index $n_D^{20}$ as 1.4353. The boiling range at atmospheric pressure was from 204 to 209° C.

A.3) Esterification 865.74 g of the isononanol fraction obtained in process step 2 (20% molar excess based on adipic acid) were reacted with 365.25 g of adipic acid and 0.42 g of isopropyl butyl titanate catalyst in a 2 l autoclave into which nitrogen was bubbled (10 l/h) with a stirrer speed of 500 rpm and a reaction temperature of 230° C. The water formed in the reaction was removed progressively from the reaction mixture with the nitrogen stream. The reaction time was 180 min. The nonanol excess was then distilled off at a reduced pressure of 50 mbar. 1000 g of the crude diisononyl adipate were neutralized by stirring for 10 minutes at 80° C. with 150 ml of 0.5% strength aqueous sodium hydroxide. This gave a two-phase mixture with an upper organic phase and a lower aqueous phase (waste liquor with hydrolyzed catalyst). The aqueous phase was separated off, and the organic phase subjected to two further washings with 200 ml of $H_2O$. For further purification, the neutralized and washed diisononyl adipate was stripped using steam at 180° C. and a reduced pressure of 50 mbar for two hours. The purified diisononyl adipate was then dried for 30 min at 150° C./50 mbar by passing a nitrogen stream (2 l/h) through the material, then mixed with activated carbon for 5 min and filtered off with suction via a suction filter using Supra-Theorit 5 filtration aid (temperature 80° C.).

The resultant diisononyl adipate has a density of 0.920 g/cm$^3$ and a refractive index $n_D^{20}$ of 1.4500.

B) Viscosity Measurement

The viscosity of the esters is determined in a standard test according to DIN 51562-1.

The viscosity of the ester prepared according to the procedure describes above is 10.56 mm$^2$/s at 40° C. determined according to DIN 51562-1. The viscosity of the ester prepared according to the procedure describes above is 3.0 mm$^2$/s at 100° C. determined according to DIN 51562-1.

The viscosity index is 150 determined according to ASTM D 2270.

C) Testing of Compatibility with Sealing Material

The seal compatibility test with sealing material acrylonitrile-butadiene-copolymer was performed at 100° C. for 168 hours according to the standard method ISO 1817 in the presence of the ester as obtained under A.3).

The sealing material showed a volume change of +29.0% (expansion).

D)

TABLE 1

Lubricant formulations A and B (all values in weight-%)

| | Formulation A with DIDA | Formulation B with Ester according to Example A.3 |
|---|---|---|
| PAO 6 (Nexbase ® 2006, polyalphaolefin, obtainable from Neste Oil N.V, Belgium) | 52.0% | 52.0% |
| DIDA | 10.0% | — |
| Ester according to Example A.3 | — | 10.0% |
| Thickener (Lubrizol ® 8406, polyisobutylene, available from Lubrizol) | 13.0% | 13.0% |
| Thickener (Lubrizol ® 8407 from Lubrizol) | 13.0% | 13.0% |
| Additives (Anglamol ® 6004, additive package available from Lubrizol) | 12.0% | 12.0% |
| Viscosity at 40° C. DIN 51562-1 | 113.8 mm$^2$/s | 110.1 mm$^2$/s |

TABLE 1-continued

Lubricant formulations A and B (all values in weight-%)

| | Formulation A with DIDA | Formulation B with Ester according to Example A.3 |
|---|---|---|
| Viscosity at 100° C. DIN 51562-1 | 16.7 mm$^2$/s | 15.1 mm$^2$/s |
| Viscosity index (VI) ASTM D 2270 | 160 | 157 |
| Density at 15° C. DIN 51757 | 0.8660 g/ml | 0.8672 g/ml |
| Cloud Point DIN ISO 3015 | −32.0° C. | <−80.0° C. |

DIDA is commercially available for example as Synative® ES DIDA from BASF SE, Ludwigshafen The seal compatibility test with sealing material acrylonitrile-butadiene-copolymer was performed at 100° C. for 168 hours according to the standard method ISO 1817 in the presence of formulation A and formulation B, respectively.

The sealing material showed a volume change of +12.0% (expansion) in the presence of formulation A and a volume change of 12.5% (expansion) in the presence of formulation B.

The invention claimed is:

1. A lubricant composition comprising:

A) at least one lubricating base oil which is a poly-α-olefin (PAO) in an amount from 30 to 90% by weight, B) at least one polyester in an amount from 3.5 to 45% by weight and obtainable by reacting adipic acid and an alcohol mixture comprising 1-nonanol, monomethyloctanols, dimethylheptanols and monoethylheptanols having a viscosity at 40° C. in the range of 8 to 12 mm$^2$/s determined according to DIN 51562-1 and C) one or more lubricating oil additives in an amount from 0.1 to 40% by weight wherein the lubricant composition has a cloud point of less than −80° C.

2. The lubricant composition according claim 1, wherein the alcohol mixture contains a proportion of 25% by weight to 55% by weight monomethyloctanols, based on the overall weight of the alcohol mixture.

3. The lubricant composition according to claim 1, wherein the alcohol mixture contains a proportion of 10% by weight to 30% by weight dimethylheptanols, based on the overall weight of the alcohol mixture.

4. The lubricant composition according to claim 1, wherein the alcohol mixture contains a proportion of 6% by weight to 16% by weight 1-nonanol, 25% by weight to 55% by weight monomethyloctanols, 10% by weight to 30% by weight dimethylheptanols and 7% by weight to 15% by weight monoethylheptanols, based on the overall weight of the alcohol mixture.

5. The lubricant composition according to claim 1, wherein the lubricating oil additives are selected from the group consisting of lubricity improvers, viscosity improvers, combustion improvers, corrosion and/or oxidation inhibiting agents, pour point depressing agents, extreme pressure agents, antiwear agents, antifoam agents, detergents, dispersants, antioxidants, and metal passivators.

6. The lubricant composition according claim 3, wherein the alcohol mixture contains a proportion of 25% by weight to 55% by weight monomethyloctanols, based on the overall weight of the alcohol mixture.

7. The lubricant composition according claim 5, wherein the alcohol mixture contains a proportion of 25% by weight to 55% by weight monomethyloctanols, based on the overall weight of the alcohol mixture.

8. The lubricant composition according to claim 5, wherein the alcohol mixture contains a proportion of 6% by weight to 16% by weight 1-nonanol, 25% by weight to 55% by weight monomethyloctanols, 10% by weight to 30% by weight dimethylheptanols and 7% by weight to 15% by weight monoethylheptanols, based on the overall weight of the alcohol mixture.

9. The lubricant composition according to claim 1, wherein the polyester has a viscosity index above 140.

10. The lubricant composition according to claim 1, consisting essentially of components a, b and c wherein the lubricating oil additives are selected from the group consisting of lubricity improvers, viscosity improvers, combustion improvers, corrosion inhibiting agents, oxidation inhibiting agents, corrosion and oxidation inhibiting agents, styrene-based polymers, crosslinked alkyl phenols, alkyl naphthalenes, extreme pressure agents, antiwear agents, antifoam agents, detergents, dispersants, antioxidants and metal passivators.

11. The lubricant composition according to claim 1, wherein the lubricant composition comprises 60% by weight to 90% by weight of component A), 10% by weight to 25% by weight of component B) and 2.0% by weight to 20% by weight of component C).

12. A lubricant composition comprising:

A) at least one lubricating base oil which is a poly-α-olefin (PAO),

B) at least one polyester obtainable by reacting adipic acid and an alcohol mixture comprising 1-nonanol, monomethyloctanols, dimethylheptanols and monoethylheptanols wherein the at least one polyester has a viscosity at 40° C. in the range of 8 to 12 $mm^2/s$ determined according to DIN 51562-1, a viscosity index above 140, a density at 20° C. according to DIN 51757 of from 0.90 to 0.94 $g/cm^3$ and a refractive index $n_D^{20}$ according to DIN 51423 is from 1.440 to 1.460 and the alcohol mixture contains a proportion of 6% by weight to 16% by weight 1-nonanol, 25% by weight to 55% by weight monomethyloctanols, 10% by weight to 30% by weight dimethylheptanols and 7% by weight to 15% by weight monoethylheptanols, based on the overall weight of the alcohol mixture, C) one or more lubricating oil additives are selected from the group consisting of lubricity improvers, viscosity improvers, combustion improvers, corrosion and/or oxidation inhibiting agents, pour point depressing agents, extreme pressure agents, antiwear agents, antifoam agents, detergents, dispersants, antioxidants and metal passivators, and wherein the lubricant composition comprises 50% by weight to 90% by weight of component A), 3.5 to 45% by weight of component B) and 0.1% by weight to 40% by weight of component C) and wherein the lubricant composition has a cloud point of less than −80° C.

13. The lubricant composition according to claim 12, wherein the lubricant composition comprises 60% by weight to 90% by weight of component A), 10% by weight to 25% by weight of component B) and 3.5% by weight to 20% by weight of component C).

14. The lubricant composition according to claim 13, wherein the polyester is derived from a mixture which consists essentially of 11.0% 1-nonanol
20.8% 6-methyl-1-octanol
20.5% 4-methyl-1-octanol
5.3% 2-methyl-1-octanol
11.0% 2,5-dimethyl-1-heptanol
8.7% 3-ethyl-1-heptanol
6.2% 4,5-dimethyl-1-heptanol
2.9% 2-ethyl-1-heptanol
2.8% 2,3-dimethyl-1-heptanol
3.0% 2-ethyl-4-methyl-1-hexanol
2.7% 2-propyl-1-hexanol and
1.6% 3-ethyl-4-methyl-1-hexanol.

15. The lubricant composition according to claim 12, wherein the viscosity of the lubricant composition at 40° C. is from 80 to 120 $mm^2/s$ determined according to DIN 51562-1.

* * * * *